United States Patent [19]

Rutter

[11] 4,391,550

[45] Jul. 5, 1983

[54] GUNNEL SUPPORT SYSTEM FOR USE WITH A BOAT LIFT

[75] Inventor: Henry A. Rutter, Claremore, Okla.

[73] Assignee: National Hydro-Hoist Company, Claremore, Okla.

[21] Appl. No.: 282,967

[22] Filed: Jul. 13, 1981

[51] Int. Cl.[3] ..... B63C 5/02

[52] U.S. Cl. ..... 405/7; 114/45; 405/3

[58] Field of Search ..... 405/1–7; 114/44, 45

[56] References Cited

U.S. PATENT DOCUMENTS

| | | | |
|---|---|---|---|
| 710,170 | 9/1902 | Weindorf | 405/3 |
| 735,569 | 8/1903 | Nelssen | 114/45 |
| 955,130 | 4/1910 | Burwell | 405/7 X |
| 1,289,781 | 12/1918 | Hubbell | 405/7 X |
| 1,390,056 | 9/1921 | Nieberding | 405/4 |
| 1,407,375 | 2/1922 | Burbank | 405/7 |
| 2,151,394 | 3/1939 | Rogers | 405/3 |
| 3,221,899 | 12/1965 | Gronlund | 405/7 X |

*Primary Examiner*—Dennis L. Taylor

*Attorney, Agent, or Firm*—William S. Dorman

[57] ABSTRACT

In combination with a boat lift of the type having a plurality of opposed floatation tanks being affixed to a main structure and an horizontally disposed intermediate platform extending therebetween; a gunnel supporting system which comprises a plurality of paired stabilizing arms, and a crossbeam for each pair of stabilizing arms horizontally and transversely disposed beneath the platform; each pair of stabilizing arms consists of a first stabilizer arm and a second stabilizer arm transversely spaced from each other, each stabilizer arm being vertically disposed and extending through the platform so as to be pivotally connected to its associated crossbeam; a flange for pivotally connecting each stabilizer arm to its crossbeam, a retainer bolt for maintaining each stabilizer arm in a relative vertical position, a winch and a tension cable attached to the lower ends of the stabilizer arms for pivoting the same toward each other in a transverse plane thereby engaging the sides of a boat within the stabilizer arms, and a plurality of openings in the crossbeam for receiving the retainer bolts and thus providing transverse adjustment of said stabilizer arms.

5 Claims, 4 Drawing Figures

GUNNEL SUPPORT SYSTEM FOR USE WITH A BOAT LIFT

BACKGROUND OF THE INVENTION

1. Field of the Invention

The present invention relates to an improved stabilizing apparatus for a boat lift. More particularly, the present invention relates to a gunnel support system for use with an individual dry dock or boat lift.

2. Prior Art

Dry docks and their related stabilizing equipment are well known in the prior art. Various stabilizing devices include butting rods or bars which support the hull and prevent it from tilting in the dry dock. No prior art teaches a self-centering device which quickly engages a floating boat. No prior art apparatus is readily adjustable to fit different boat widths.

SUMMARY OF THE INVENTION

The supporting system of the present invention provides a means whereby a boat is centered within an individual boat lift or dry dock while the boat is still floating, although its keel resting on the bottom of the dry dock. The stabilizer arms of the present invention can be quickly tightened thus securing the boat in an upright position. The present invention can be readily adjusted to fit different boat widths. The tightening means, herein a tension cable, does not need to be adjusted for the different width settings.

The gunnel support system of the present invention includes a stabilizer arm and a crossbeam. The crossbeam is located underneath an intermediate work platform extending between a plurality of floatation tanks which are on opposite sides of a boat lift. The boat lift is provided with a plurality of floatation tanks which are an opposite sides of a boat lift. The boat lift is also provided with a plurality of paired stabilizer arms which engage a pleasure boat thus securing it in an upright position.

The stabilizer arms are vertically disposed and extend through and swing in openings provided in the work platform so as to be pivotally attached to an associated crossbeam. Each of the stabilizer arms comprises a gunnel support column and a connecting flange which is affixed to the support column along its lower third. The connecting flange engages the crossbeam and is pivotally attached thereto by means of a pivot pin which extends through suitable holes in the flange and the crossbeam. The support column is held in position by means of a retainer bolt which is received in a suitable opening directly adjacent the pivot pin. The crossbeam is provided with a plurality of openings allowing for horizontal adjustment of the stabilizer arms for different boat widths. The gunnel support column is also provided with support pads or bolsters which are connected to the upper ends of each column by means of ring fasteners or the like.

A winch is conveniently located on the structure of the boat lift and is provided with a tension cable, which is received through a suitable opening in the work platform. The cable can be wound up or tightened by means of the winch. One portion of the cable is attached to the lower end of a first stabilizer arm (of a pair) after passing around a first pulley. The remote end of the cable is attached to the lower end of a second stabilizer arm after passing around a second pulley.

When the cable is tightened by means of winding it around the winch, the first stabilizer arm moves in a clockwise direction around its pivot point and the second stabilizer arm moves in a counter-clockwise direction around its respective pivot point. The above movement of the arms brings the bolsters into engagement with the sides or gunnels of a boat positioned in the center area of the work platform, with the keep of the boat resting on the work platform or on an auxiliary flooring on the work platform.

The boat lift or dry dock, as thus described, is not designed primarily for storage purposes, but is more properly defined as a service lift. There are no supporting devices, except for the stabilizer arms, resting against the side of the boat; thus, the boat can be readily serviced by scraping, painting, etc., without interference from such side supporting structures.

DETAILED DESCRIPTION OF THE PREFERRED EMBODIMENTS

Figure 1:
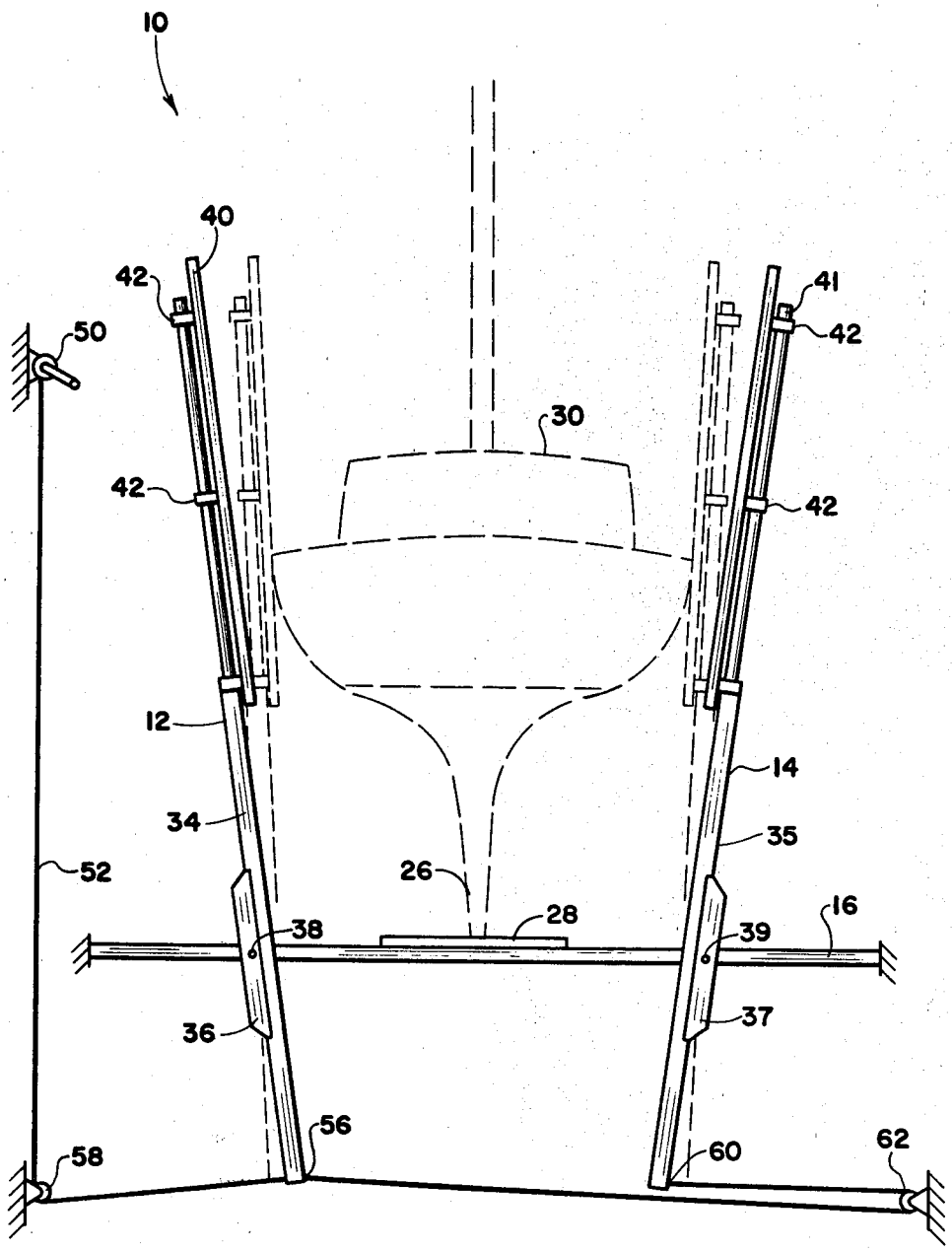
FIG. 1 is a front elevational view of the the gunnel support system of the present invention and showing, in dotted lines, the engagement of a boat by the present invention.
Figure 2:
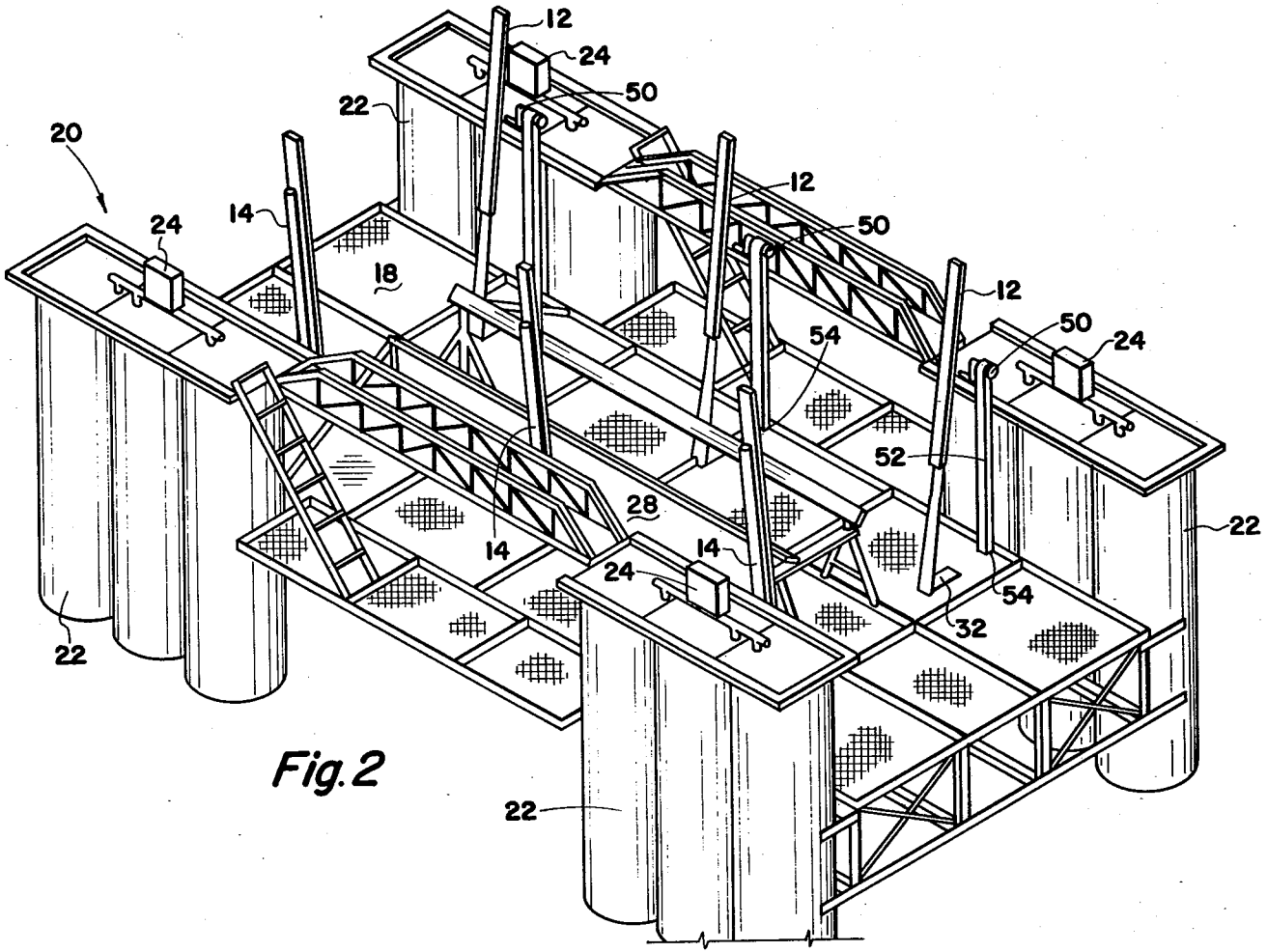
FIG. 2 is a perspective view of an individual boat lift having a plurality of paired stabilizer arms in accordance with the present invention.

Referring to FIGS. 1 and 2 in detail, the gunnel support system 10 of the present invention includes a pair of stabilizer arms 12 and 14 and a crossbeam 16. The crossbeam 16 (not shown in FIG. 2) is transversely disposed beneath an intermediate work platform 18 of an individual dry dock or boat lift 20. The boat lift 20 is provided with a plurality of opposed pontoons or floatation tanks 22 with the work platform 18 extending therebetween. The floatation tanks 22 are provided with an air injection unit 24 whereby compressed air is injected into tanks 22 to raise the boat lift 20 out of the water until the keel 26 of the boat 30 (diagrammatically represented by dotted lines in FIG. 1) comes to rest on flooring or planks 28 disposed over the work platform 18.

The stabilizer arms 12 and 14 are vertically disposed and extend through and swing in suitable openings 32 in the work platform 18. The stabilizer arms are adapted so as to be pivotally connected to its associated crossbeam 16. The stabilizer arms 12 and 14 comprise gunnel support columns 34 and 35, respectively, and connecting flanges 36 and 37, respectively. The connecting flanges 36 and 37 are affixed to support columns 34 and 35, respectively, along the outer sides of the support columns, each at a point approximately one third the distance above the lower end of its associated support column. The connecting flanges 36 and 37 engage the crossbeam 16 and are pivotally connected thereto by means of pivot pins 38 and 39, respectively. The pivot pins 38 and 39 extend through suitable holes in the connecting flange and in the crossbeam. The pivot serve as pivot points 38 and 39 about which the stabilizer arms 12 and 14 respectively, pivot. The gunnel support columns 34 and 35 are also provided with support pads or bolsters 40 and 41, respectively, which are attached to the upper ends of support column 34 and 35, respectively, by means of ring fasteners 42 or the like.

Figure 3:
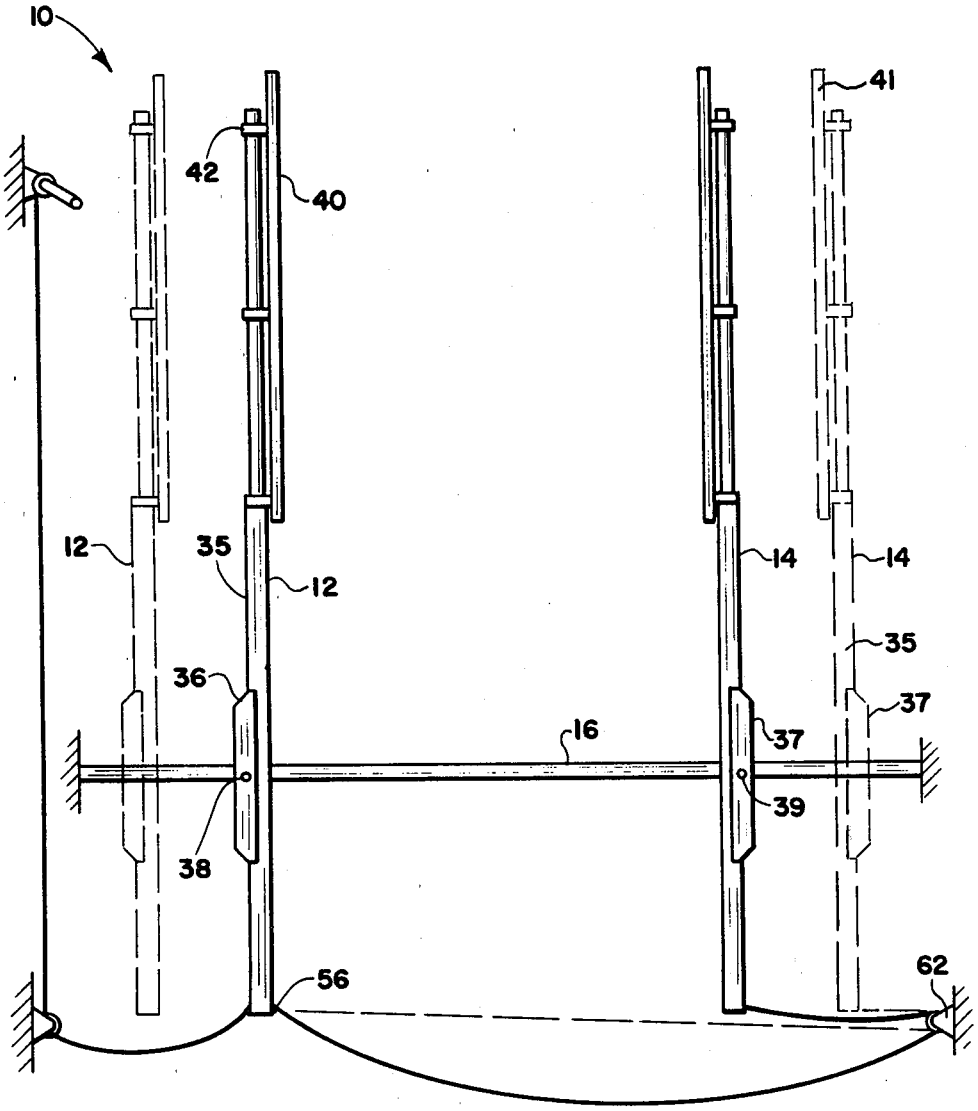
FIG. 3 is a view similar to FIG. 1 showing in an elevated position the stabilizer arms and showing, in dotted lines, a horizonal adjustment for different widths.
Figure 4:
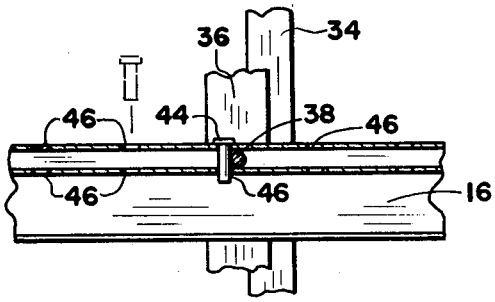
FIG. 4 is a cross-sectional detailed view of the attachment portion shown circled in FIG. 3.

Referring to FIGS. 3 and 4, the support columns 34 and 35 are each held in relative vertical position by means of a retainer bolt 44 (see FIG. 4) received in a suitable opening 46 located in the crossbeam directed adjacent to the pivot pin 38 (or 39). As shown, the crossbeam 16 is provided with a plurality of vertically extending openings 46 for selectively receiving retainer bolt 44, thus providing a means for the horizontal adjustment of the stabilizer arms 12 and 14, as indicated by the dashed lines in FIG. 3, and allows for adjusting the arms for various boat widths. Although FIG. 3 shows the details of the connection for the left-hand stabilizer arm 12 and its associated pivot pins 38, it should be understood that an identical arrangement is provided for the righthand stabilizer arm 14, the only difference being that the retainer bolt would be located to the right of pivot pin 39.

Returning to further consideration of FIGS. 1 and 2, a winch 50 is conveniently located on the structure of boat lift 20 adjacent one (12) of the stabilizer arms of the pair. It should be understood that each pair of stabilizer arms, 12 and 14, is provided with a separate winch 50 as shown in FIG. 2. Each winch 50 is provided with a tension cable 52 which passes through a suitable opening 54 in the work platform 18. One portion of cable 52 is connected at a point 56 to the lower end of the first stabilizer arm 12 after passing around a first pulley 58. The remote end 60 of cable 52 is connected to the lower end of the second stabilizer arm 14 after passing around a second pulley 62.

After boat 30 has been manuevered into the central area of boat lift 20 between the stabilizer arms 12 and 14, and the keel 26 has come to rest on the flooring 28, the cable 52 is tightened by means of winding it around the winch 50. As shown by the dashed lines position in FIG. 1, the first stabilizer arm 12 moves in a clockwise direction around its pivot point 38 and the second stabilizer arm 14 moves in a counter-clockwise direction around its respective pivot point 39. The above movement of stabilizer arms 12 and 14 brings the respective support pads 40 and 41 into engagement with the sides of boat 30, thus securing boat 30 in an upright position.

Whereas the present invention has been described in particular relation to the drawings attached hereto, it should be understood that other and further modifications, apart from those shown or suggested herein, may be made within the spirit and scope of this invention.

What is claimed is:

1. In combination with a boat lift of the type having a plurality of opposed floatation tanks affixed to a main structure and an intermediate horizontally disposed platform extending therebetween, for receiving and supporting a boat thereon in a substantially longitudinal alignment with said boat lift; a gunnel supporting system which comprises a plurality of paired stabilizing arms, a crossbeam of each pair of stabilizing arms, said crossbeam being horizontally and transversely disposed beneath said platform, each pair of stabilizing arms having a first stabilizer arm and a second stabilizer arm being transversely spaced from each other, each stabilizer arm being vertically disposed and extending through said platform so as to be pivotally connected to its associated crossbeam, means for pivotally connecting said stabilizer arm to said crossbeam, means for maintaining said stabilizer arm in a relative vertical position, means for pivoting said stabilizer arms toward each other in a transverse plane thereby engaging the sides of a boat within said stabilizer arms, and a means providing transverse adjustment of said stabilizer arms.

2. Gunnel supporting system as set forth in claim 1 wherein means for pivotally connecting said stabilizer arm to said crossbeam comprises a flange being affixed to the lower third of said stabilizer arm whereby said flange engages said crossbeam and pivotally mounted thereto by a pivot pin being received in said flange and said crossbeam.

3. Gunnel supporting system as set forth in claim 2 wherein means for maintaining said stabilizer arm in a relative vertical position comprises a retainer bolt being received in a suitable opening in said crossbeam directly adjacent said pivot pin.

4. Gunnel supporting system as set forth in claim 3 wherein said means providing transverse adjustment of said stabilizer arms comprises a plurality of suitable opening in said crossbeam for receiving said retainer bolt.

5. Gunnel supporting system as set forth in claim 1 wherein means for pivoting said stabilizer arms comprises a winch being attached to said main structure adjacent to said first stabilizer arm and having a tension cable, said tension cable extending through said platform and having a portion thereof attached to the lower end of said first stabilizer arm and having the remote end thereof attached to the lower end of said second stabilizer arm, whereby the tightening of said cable by said winch causes said stabilizer arms to pivot inwardly toward each other thereby engaging the sides of a boat positioned therebetween.

* * * * *